United States Patent [19]

Watanabe et al.

[11] 4,164,476

[45] Aug. 14, 1979

[54] DEVELOPER FOR LATENT ELECTROSTATIC IMAGE AND PROCESS FOR PREPARATION THEREOF

[75] Inventors: Shotaro Watanabe; Fumio Koizumi; Katsutoshi Tozawa; Shigeru Uetake, all of Hino, Japan

[73] Assignee: Konishiroku Photo Industry Co. Ltd., Hachioji, Japan

[21] Appl. No.: 867,500

[22] Filed: Jan. 6, 1978

Related U.S. Application Data

[62] Division of Ser. No. 805,213, Jun. 9, 1977.

[30] Foreign Application Priority Data

Jun. 9, 1976 [JP] Japan ..... 51-66568

[51] Int. Cl.$^2$ ..... G03G 9/08

[52] U.S. Cl. ..... 252/62.1 P; 96/1 SD

[58] Field of Search ..... 252/62.1 P, 62.1 PM, 252/62.54; 96/1 SD; 428/407

[56] References Cited

U.S. PATENT DOCUMENTS

| | | | |
|---|---|---|---|
| 3,196,032 | 7/1965 | Seymour | 252/62.1 P |
| 3,627,682 | 12/1971 | Hall et al. | 252/62.1 P |
| 3,645,770 | 2/1972 | Flint | 252/62.1 PM |
| 3,674,736 | 7/1972 | Lerman et al. | 252/62.1 P |
| 3,819,367 | 6/1974 | Chatterji et al. | 252/62.1 P |
| 3,900,588 | 8/1975 | Fisher | 252/62.1 P |
| 4,031,021 | 6/1977 | Deming | 252/62.1 PM |

FOREIGN PATENT DOCUMENTS

| | | | |
|---|---|---|---|
| 2538112 | 3/1976 | Fed. Rep. of Germany | 252/62.1 P |

*Primary Examiner*—Roland E. Martin, Jr.
*Attorney, Agent, or Firm*—Finnegan, Henderson, Farabow and Garrett

[57] ABSTRACT

The present invention is for the improvements of a developer for a one-component latent electrostatic image and the process for the preparation thereof. The present invention is the one which has improved points at issue in the case of using a developer for the conventional conductive one-component latent electrostatic image for a copying machine using a corona discharger and in which particles are prepared by uniformly mixing a magnetic substance in resin and the magnetic substance is substantially exposed on the particle surface by heat treatment and hydrophobic silica fine powders are supported on, or interposed in, said particles; the particles are, as a whole, electrically insulating and given electric charge necessary to form an image by friction of mutual particles; thus even in a copying machine using a corona discharger, good development can be obtained with this developer; and further the present invention is the one which provides a process for the preparation of said particles.

6 Claims, No Drawings

DEVELOPER FOR LATENT ELECTROSTATIC IMAGE AND PROCESS FOR PREPARATION THEREOF

This is a division of application Ser. No. 805,213, filed June 9, 1977, pending.

The present invention relates to a developer for a latent electrostatic image and in more detail, to the improvements of a one-component developer for a latent electrostatic image making a main component of only toner particles and containing no carrier particles.

In the development of a latent electrostatic image there are dry developing methods and wet developing methods. In both of them, as a developer there is usually used a two-component mixture consisting of a carrier and toner. In the development by said two-component developer, a toner is a component which is consumed and a carrier is the one which is not, and, for instance, in the dry developing methods, when in general a mixture of them is mechanically and fully agitated, the toner will produce a charge of polarity opposite to the carrier, they are respectively electrically charged to a specified polarity and toner particles are adhered to a latent electrostatic image to obtain a powder image.

Accordingly, if the number of uses is increased in a two-component developer consisting of a toner and a carrier, a mixing ratio of a toner component to a carrier component varies and copying of a given concentration is not guaranteed, and thus it is necessary to supplement a toner in consumed amounts. Further, there is the drawback that if the number of mechanical agitations increases, the frictional charging properties of a carrier vary and since this change causes fog and stain of a copied product, a fresh carrier must be substituted. To eliminate this drawback, a one-component developer making a main component of only a toner and containing no carrier component has been proposed. For example, U.S. Pat. No. 3,639,245 there is disclosed a so-called magnetic toner in which ferromagnetic particles such as ferroferric oxide, a thermoplastic resin such as epoxy resin and an electrically conductive carbon black are combined. Said magnetic toner could eliminate said drawback caused by a two-component developer, but on the other hand, there is the drawback that since said magnetic toner is electrically conductive, it is difficult to use a corona discharger which is most general and easy to control in transferring it to the paper, etc. That is, it is because when said magnetic toner is transferred to the paper, etc. using a corona discharger, a powder image consisting of said magnetic toner is partly or wholly destroyed and no satisfactory transferred image is obtainable.

And in Laid-open Patent Applications Nos. 17739/74 and 90335/75 there is disclosed and known an insulating toner, which is aimed at transferring a toner image to the ordinary paper. However, both are an insulating magnetic toner having a double structure provided with a resinous layer on the surface. As a method of imparting charge to these magnetic toners, it should be imparted from the outside by corona discharge, etc. Hence, there is the drawback that said corona discharger should be disposed in such a developing device, and the device becomes complicated and expensive, resulting in troublesome procedures and maintenance control.

On making research to improve this drawback, the inventors have completed a developer of only a toner, which makes main components of resin and a magnetic substance mentioned in Laid-open Patent Application No. 26046/76, said magnetic substance being fine particles having negative frictional charging properties and uniformly dispersed in resin, further which is composed of toner particles formed so that the fine particle surface of a magnetic substance is substantially exposed to the resin surface in the particle surface and which is, as a whole, electrically insulating. Said developer having a toner only has no drawback of a two-component developer consisting of the conventional toner and carrier, and since it is insulating as the whole toner, the drawback that it is difficult to use a corona discharger, which has been the drawback with an electrically conductive magnetic toner, is also eliminated. In preparing said toner there are spray dry methods using solvent series and crush granulation methods using no solvent series. When said toner particles are used, positive and negative charges are imparted to toner particles by means of friction between particles, and ears of toner particles are made with a magnet to effect good development.

However, said toner has a strong electrostatic cohesiveness, so that separation of toner particles attracted to each other electrostatically is bad and fluidity is poor, as compared with a two-component developer, the conventional one-component electrically conductive developer and a one-component developer using an insulation magnetic toner of double structure consisting of resin coated magnetic toner particles. Therefore, transportability with a screw feeder, etc. is a problem. That is, there are problems that much time is required for a classification step or a toner is fused and adhered within a screw feeder or particles which have cohered are recovered without being separated to lower classification efficiency and so forth. And there are problems that a toner prepared by the crush granulation methods most widely used in said methods of preparing a toner causes remarkable pollution to an electrophotosensitive material when it is used in an electronic copying machine doing repeated transferrings, and that on repeated use, sensitively lowers and ghosts, etc. occur and formation of an image becomes poor. It could not be said that it was satisfactory.

The present invention has been made to solve these points at issue.

It is the first object of the present invention to provide a developer for a latent electrostatic image which is a one-component developer making a main component of only a toner and containing no carrier component, the toner being electrically insulating, and a developer to impart to toner particles electric charge necessary for forming an image by friction between toner particles and a developer which has enabled the transfer of a toner image with a corona discharger.

The second object is to provide a developer in which there is no pollution of a surface of the electrophotosensitive material, no occurrence of ghosts and a good and brilliant transferred image is obtained.

The third object is to provide a method of efficiently and easily preparing said developer.

On making research to solve these points at issue, the inventors have found that the pollution of the electrophotosensitive material caused by said toner and the formation of ghosts occur when there are fine particles 1 micron or below in particle diameter on the particle surface composed of magnetic fine particles and resinous particles and when this magnetic toner is, for instance, passed through a hot air current at a temperature higher than the softening point (100°-500° C.) of the component resin, fine particles 1 micron or below in particle diameter on the surface portion can be substantially eliminated.

What is important in this heat treatment step is that a state in which toner particles are well dispersed so that they do not produce cohesive substances is preferable.

It is because these cohesive substances cohere by heat to produce large particles and thereby lower yields. When said magnetic toner is strong in cohesiveness, there can be produced a state in which the particles are well dispersed in a hot air current by the addition of hydrophobic silica particles. And it has been found that the substantial cohesiveness of said magnetic toner can be solved by letting 0.01-1.0% by weight of hydrophobic silica particles based on the total weight of the toner be contained, that is, by using them with mixing at the time of preparing the toner or mixing them with toner particles. According to these found facts, the present invention has been completed.

The present invention relates to a developer of a latent electrostatic image characterized in that hydrophobic silica is contained by 0.01-1.0% by weight based on the total weight of said magnetic toner in a magnetic toner having resin and a magnetic substance as main components, said magnetic substance and resin having a difference in frictional charge series, said magnetic substance fine particles being in a state in which they are substantially exposed from the resin surface on the particle surface, said magnetic toner comprising particles including substantially no particles 1 micron or below in particle diameter and being electrically insulating as the whole particles.

And it is essential that the magnetic toner particles, a main component of the developer for a latent electrostatic image in the present invention be $10^{14}$ Ωcm or above in its specific resistance and the decay factor of potential be 50% or below.

The value of said specific resistance is the one which is obtained by placing a brass electrode plate 4-5 mm thick on a specimen put into a container having a brass bottom, impressing a voltage of 100 V on this electrode plate in a state where a pressure of 1 kg/cm$^2$ is given to the electrode plate, and is the value of a current obtained when an absorption current has fully decreased and a measurement current has become substantially constant. And said value of decay factor of potential is the one in which development of a given area is conducted on the zinc oxide sensitized paper, toner potential at the early stage of photoirradiation and toner potential 3 minutes after photoirradiation are measured by a light-transmitting potentiometer and a ratio between both potentials is expressed percentage-wise. Further, the toner sticking to a latent electrostatic image on the sensitized body has a high amount of charge of 1-20 microcoulombs/cm$^3$.

It is desirable that a magnetic substance to be used in the present invention be negatively or positively charged by frictional charge, preferably black in color, well dispersed in resin and chemically stable and easily made into fine particles or something 1 micron or below in particle diameter, and hence, magnetite (ferrosoferric oxide) is most preferable. Besides are used an alloy or compound containing an element showing ferromagnetism such as iron, cobalt, and nickel including various types of ferrite, or an alloy such as manganese-copper-aluminum or chromium dioxide, which does not contain a ferromagnetic element but shows ferromagnetism by appropriate heat treatment. These magnetic substances are preferably about 0.1-1 micron in average particle diameter and the amount to be contained in the toner is preferably 30-60 parts by weight based on 100 parts by weight of the toner. And resin is selected in consideration of frictional charging properties with a magnetic substance to be used, a preparing process and conditions, covering properties against the magnetic substance, easiness of fixing by heat, etc. There can be used styrene resin, acrylic resin, vinyl resin, epoxy resin, cellulosic resin, polyester resin, polyurethane resin, or one or more types of copolymers thereof.

Further, besides a magnetic substance and resin, pigments or dye-stuffs can be mixed and used as a colorant. However, it is necessary that such a conductive material as carbon black be in such small amounts that it does not obstruct insulation properties.

And, if necessary, there can be mixed and used a charge controlling agent comprising other higher fatty acids, plasticizers, metallic soaps, higher alcohols, fatty amides, lubricating hydrocarbons, lubricating esters, etc.

Composition of the toner, a main component of a developer in the present invention, is selected from said many substances, and particularly resin is selected in accordance with the object of use in consideration of affinity with a ferromagnetic substance, pigments, dyestuffs, etc., frictional charging properties between a ferromagnetic substance and resin, mechanical crushability, heat fixing properties, etc.

As a process for the preparation of a developer of the present invention, a process for crush granulation so far generally carried out, can be used. For instance, toner materials such as resin, colorants, ferromagnetic substance and if necessary, a charge controlling dyestuff to be used in combination therewith are preliminarly mixed with a ball mill, etc., further heated and kneaded at a temperature lower than the melting point of the resin constituting a toner, e.g., normally at 60°-120° C. with a two-roll kneader or extruder-kneader, cooled and solidified, and pulverized with a pulverizer such as a hammer mill and a jet mill. Further, fine, powdery toner of 1.0 micron or below, sticking to large particles or electrostatically adhered to each other (Besides particles having toner's character, resin powders, magnetic substance powders and pigment powders or dye powders or mixtures thereof, which have no toner's character are included,), is eliminated by blowing a toner into a spray dryer made by Niro, Inc. together with a hot air higher than the melting point of the resin constituting said toner and letting it cohere to each other or large particles. In this step, hydrophobic silica powder is preferably added to loosen cohesion of toner particles and lead it into a hot air current.

As to the particle diameter of said toner particles, a toner of the desired particle diameter is obtained by adjusting and dispersing quantities of wind and the number of rotation with the use of a zigzag classifier made by Alpine, Inc. And in this step also, it is desirable that hydrophobic silica powder be preferably added and the cohesion of toner particles be kept loosened. Further, when the cohesion of the toner after classification is great, hydrophobic silica should be added. It is desirable that the content of said hydrophobic silica be in the range of 0.01-1.0% by weight based on the total weight of said toner.

When the content of hydrophobic silica is less than 0.01% by weight, the improvements of cohesiveness of the toner are difficult to make, and when it exceeds 1.0% by weight, image concentration decreases extremely and fog occurs.

As hydrophobic silicas are exemplified Aerosil R-972 (made by Aerosil, Japan), D-17 (made by Degussa Co.), etc. They are preferably fine powders 100 mμ or below in particle diameter. And hydrophilic silicas, which have not been subjected to a hydrophobising treatment, e.g. Aerosil # 200, have the drawback that they have an attraction for water and thus suffer a decrease in specific resistance when in contact with an atmosphere of high humidity. As a result, a dim image is obtained when a toner image comprising such a hydrophilic silica is transferred to a paper.

And in mixing fine powder of said hydrophobic silica, it is sufficient to place hydrophobic silica fine powders in a mixer of gravity-drop system such as a V-type mixer and a tubular mixer and, while mixing operations are being continued, gradually add an intermediate. In this case it is necessary not to impart an excessive shear force to the mixing line and to conduct mixing operations gently. However, simple mixing methods will take several hours up to termination of mixing, and what is more, it is difficult to perfectly break down the mass of hydrophobic silica fine powders strongly cohered and mix it.

Thus, a spherical substance such as glass, porcelain and iron 0.2–4 mm in diameter is added to the mixing line so as not to give the intermediate an excessive shear force for the efficient mixing of these cohesive particles. For instance, 100 parts by weight of the intermediate and 0.3 part by weight of hydrophobic silica fine powders are placed in a V-type mixer at the same time and 30 parts by weight of glass beads 1–2 mm in diameter against said intermediate; and mixing is conducted; then spherical substances are passed through a sieve of 100 mesh and removed.

According to such methods, the secondary cohered bodies of said silica fine powders are completely collapsed after about 20 minutes and the one in which individual fine powders are dispersed uniformly in intermediate particles, can be obtained.

The developer for a latent electrostatic image of the present invention obtained as described above has no drawback of the conventional two-component toner and carrier because it uses specifically composed magnetic toner particles and is a one-component series, without using a carrier, but has the following excellent characteristics: Because the magnetic toner particles are electrically insulating as a whole, a clear image is obtained even in the transferring using a corona discharger which is held to be the drawback of an electrically conductive magnetic toner, and by letting it contain hydrophobic silica, the substantial cohesiveness of said magnetic toner can be improved, classification efficiency is good, abrasion resistance of a fixed image is good, master pollution decreases and heat resistance is enhanced.

EXAMPLE 1

Epon 1004 (epoxy resin made by Shell Chemical)—240 g
Styrene (90 mol%)/dimethylaminoethylmethacrylate (10 mol%) copolymer—12 g
Ferrosoferric oxide, powders, Mapico black BL-500 (made by Chitan Industrial Co.)—360 g
Toluene—280 g
Acetone—120 g After the above was dispersed 32 hours in a porcelain ball mill and granulated by spray dry methods of rotary disc type. The conditions of spray drying are as follows
Solvent Toluene—1,680 g
Acetone—720 g
Non-volatile solid portion—600 g
Number of rotation of disc—44,000 rpm
Temperature of dry air—170° C.

By this, ferrosoferric oxide and epoxy resin were uniformly mixed; on the particle surface ferrosoferric oxide was exposed from the surface of epoxy resin, and black spherical toner particles about 10 microns in average particle diameter, in which the whole toner is electrically insulating, were obtained. To 500 g of said magnetic toner were added 1.5 g (0.3% by weight) of hydrophobic silica fine powders (Aerosil R-972) (made by Aerosil, Japan); mixed with a V-type mixer; further classified to an average particle diameter of 12 microns using a zigzag classifier. To the classified toner was further added 0.1% by weight of Aerosil R-972 to obtain a developer.

EXAMPLE 2

Without being preliminarily mixed, with the use of a pressure kneader, 50 parts by weight of Hymer SBM-73 (made by San-yo Chemical), styreneacrylic resin having a melting point of 120° C., 50 parts by weight of Mapico Black BL-100 (made by Chitan Industrial Co.), 1.5 parts by weight of Oil Black BS (made by Orient Chemical), 2.0 parts by weight of zinc stearate and 1.0 part by weight of Carbon MA-100 (made by Mitsubishi Chemical) were fused and kneaded directly. Then it was cooled and pulverized to obtain fine powders, and further blown into a hot air current at 250° C. in a spray dryer with the use of air nozzles to conduct heat treatment. To this was added with mixing 0.01% by weight of Aerosil R-972 (made by Aerosil, Japan) and a toner 13 microns in average particle diameter was obtained with a zigzag classifier. Said toner is not cohesive but usable as it is as a developer.

EXAMPLE 3

Copolymer having a melting point of 105° C. obtained by copolymerizing diethylaminoethylmethacrylate and styrene at a copolymerization ratio of 5:95—55 parts by weight
Calcium stearate—2.0 parts by weight
Mapico Black BL-100 (made by Chitan Industrial Co.-)—45 parts by weight
Carbon MA-8 (made by Mitsubishi Chemical)—2 parts by weight were fused and kneaded directly with the use of a pressure kneader, without being preliminarily mixed. This was cooled and pulverized into fine powders and 0.5% by weight of Aerosil R-972 (made by Aerosil, Japan) was added for mixing and blown into a hot air current at 240° C. in a spray dryer with the use of air nozzles to conduct heat treatment. To this was added with mixing 0.2% by weight of Aerosil R-972 and the mixture was classified with a zigzag classifier to obtain a toner 10 microns in average particle diameter.

On conducting development tests between said toner as obtained and the one in which further 0.1–1.0% by weight of Aerosil R-972 was added with mixing to said toner, it was found that the one in which the total usage of Aerosil R-972 exceeded 1.0% by weight brought extremely poor image quality. With a developing device portion detached from a commercial copying machine of U-Bix 800 type (made by Konishiroku Photo Industrial), a master platform was pulled out when a latent image was completed on the master paper (zinc oxide sensitized substance), and development was conducted with the toner obtained by the steps of said Examples 1-3 with the use of an electromagnetic brush developing device having magnetic poles different from each other. After the master platform was again mounted, charge was given and an electric source of an exposure device was switched off. Then transferring was conducted on the ordinary paper, resulting in a good image.

EXAMPLE 4

Hymer—SBM—73 (styrene-acrylic resin made by Sanyo Chemical)—50 parts by weight
Mapico Black BL-100 (ferrosoferric oxide made by Chitan Industrial Co.)—50 parts by weight
Oil Black BS (made by Orient Chemical)—1.5 parts by weight
Carbon Black MA-100 (made by Mitsubishi Chemical-)—1.0 parts by weight were mixed and kneaded directly with a pressure kneader without being preliminary mixed. This was cooled and crushed into fine powders to obtain a developer intermediate. To 100 parts by weight of this intermediate were added 0.1 part by weight of Aerosil R-972 (Aerosil, Japan) and further 100 parts by weight of iron balls about 0.5 mm in diameter; the mixture was introduced directly in a V-type mixer, mixed for 30 minutes and then the iron balls were removed with a sieve of 100 mesh. This intermediate containing fine powders was blown into an hot air current of 230° C. in a spray dryer to conduct heat treatment. To 100 parts by weight of the thus obtained intermediate were added 0.2 part by weight of Aerosil R-972 and 30 parts by weight of glass beads about 3 mm in diameter. The mixture was introduced directly in a V-type mixer and mixed for 45 minutes and the glass beads were separated with a sieve of 100 mesh. Then, the mixture was subjected to classification with a zigzag classifier, and classification was conducted at two points of 5 μm and 25 μm to produce a developer for a latent electrostatic image as specimen 1.

There were measured the ratio by weight (product yield %) of the final product developer obtained by classifying to the intermediate after crushing, the ratio by weight (maximal of the classified amount %) intermediate 25 μm or above in particle diameter, and the weight average particle diameter μm.

As a result, the Product yield % was 75 weight %, Maximal classified amount % was 15 weight % and the weight average particle diameter was 13 μm. Thus, it was found that the Product yield % is quite high and Maximal classified amount % is quite small.

What is claimed is:

1. A process for the preparation of a developer for a latent electrostatic image comprising:
(1) mixing 0.01-1.0% by weight of hydrophobic silica fine powder with a one-component developer for a latent electrostatic image having as a main component a magnetic toner obtained by mixing and kneading powders of a magnetic substance uniformly in particles of resin, crushing said mixture into a fine powder, and heat treating said fine powder at a temperature higher than the softening point of said resin to substantially eliminate particles less than 1 micron in diameter, said powders of magnetic substance being exposed to the particle surface of said resin, said magnetic toner being, as a whole, electrically insulating and having a specific resistance of at least $10^{14}$ ohm-cm and acquiring the electric charge necessary for the formation of an image by mutual friction among the particles; and
(2) classifying said developer mixed with said hydrophobic silica fine powder into portions having a predetermined range of particle diameters.

2. The process for the preparation of a developer for a latent electrostatic image as set forth in claim 1 wherein said one-component developer has a decay factor of potential of 50% or below.

3. A process for the preparation of a developer for a latent electrostatic image comprising:
(1) mixing 0.01-1.0% by weight of hydrophobic silica fine powder with a one-component developer for a latent electrostatic image having as a main component a magnetic toner obtained by mixing and kneading powders of a magnetic substance in particles of resin and crushing said mixture into a fine powder, said powders of a magnetic substance being exposed to the particle surface of said resin, said magnetic toner being, as a whole, electrically insulating and having a specific resistance of at least $10^{14}$ ohm-cm and acquiring the electric charge necessary for the formation of an image by mutual friction among the particles;
(2) placing said developer mixed with said hydrophobic silica fine powder in an atmosphere at a temperature higher than the softening point of said resin to substantially eliminate particles less than 1 micron in diameter; and
(3) classifying said developer thus heat treated into portions having a predetermined range of particle diameters.

4. The process for the preparation of a developer for a latent electrostatic image as set forth in claim 3 wherein temperatures in said atmosphere higher than the softening point of said resin are in the range of 100° to 500° C.

5. The process for the preparation of a developer for a latent electrostatic image as set forth in claim 3 wherein said one-component developer has a decay factor of a potential of 50% or below.

6. The process for the preparation of a developer for a latent electrostatic image as set forth in claim 3 further comprising, after the heat treatment step, mixing additional hydrophobic silica fine powder with said developer prior to said classifying step.

* * * * *